US007833133B2

(12) United States Patent
Stewart et al.

(10) Patent No.: US 7,833,133 B2
(45) Date of Patent: Nov. 16, 2010

(54) END OF TRAVEL STOP FOR AN EXERCISE DEVICE

(75) Inventors: Jonathan M. Stewart, Seattle, WA (US); Rodney P. West, Kirkland, WA (US); David E. Dyer, Renton, WA (US); James S. Birrell, Seattle, WA (US); Sean Horita, Seattle, WA (US)

(73) Assignee: Precor Incorporated, Woodinville, WA (US)

( * ) Notice: Subject to any disclaimer, the term of this patent is extended or adjusted under 35 U.S.C. 154(b) by 316 days.

(21) Appl. No.: 11/646,882

(22) Filed: Dec. 28, 2006

(65) Prior Publication Data

US 2008/0161164 A1 Jul. 3, 2008

(51) Int. Cl.
*A63B 22/04* (2006.01)

(52) U.S. Cl. ..... 482/52

(58) Field of Classification Search ..... 482/52, 482/51, 53, 57, 70, 71, 79, 80, 909; D21/668, D21/669, 670, 671; 434/247, 255
See application file for complete search history.

(56) References Cited

U.S. PATENT DOCUMENTS 3,807,727 A * 4/1974 Ferguson ..... 482/71
4,934,690 A * 6/1990 Bull ..... 482/52
5,238,462 A * 8/1993 Cinke et al. ..... 482/52
5,314,390 A * 5/1994 Westing et al. ..... 482/6
5,318,490 A * 6/1994 Henderson et al. ..... 482/53
5,368,533 A * 11/1994 Feuer et al. ..... 482/70
5,374,227 A * 12/1994 Webb ..... 482/52
5,385,063 A * 1/1995 Wang ..... 74/89.22
5,419,751 A * 5/1995 Byrd et al. ..... 482/138
5,501,646 A * 3/1996 Miller ..... 482/11
5,577,985 A * 11/1996 Miller ..... 482/52
5,653,662 A * 8/1997 Rodgers, Jr. ..... 482/52
5,735,774 A * 4/1998 Maresh ..... 482/57
5,749,807 A * 5/1998 Webb ..... 482/52
5,769,760 A * 6/1998 Lin et al. ..... 482/52
5,788,610 A * 8/1998 Eschenbach ..... 482/52
5,795,268 A * 8/1998 Husted ..... 482/51
5,846,166 A * 12/1998 Kuo ..... 482/52
5,848,954 A * 12/1998 Stearns et al. ..... 482/52
5,857,940 A * 1/1999 Husted ..... 482/51
5,857,941 A * 1/1999 Maresh et al. ..... 482/52
5,868,650 A * 2/1999 Wu ..... 482/62
5,911,649 A * 6/1999 Miller ..... 482/52
5,989,159 A * 11/1999 Chen et al. ..... 482/52
6,004,244 A * 12/1999 Simonson ..... 482/52
6,042,512 A * 3/2000 Eschenbach ..... 482/52

(Continued)

*Primary Examiner*—Loan Thanh
*Assistant Examiner*—Daniel F Roland
(74) *Attorney, Agent, or Firm*—Terence P. O'Brien; Todd A. Rathe

(57) ABSTRACT

An exercise apparatus for a user. The exercise apparatus includes a frame, a crank system coupled to the frame, a pivotal linkage pendulum system, a foot member and a foot member end of travel apparatus. The crank system includes one or more crank members. The pivotal linkage pendulum system comprises at least a first link member. The first link member is coupled to the crank system through at least a first pivot point. The first pivot point of the first link member is configured to move in a path during use. The foot member is coupled to the at least one first link member. The foot member end of travel apparatus provides a two-stage stiffness profile to the foot member indicating the end of travel to the user.

40 Claims, 8 Drawing Sheets

U.S. PATENT DOCUMENTS 6,045,487 A * 4/2000 Miller ..... 482/52
6,077,197 A * 6/2000 Stearns et al. ..... 482/52
6,123,650 A * 9/2000 Birrell ..... 482/70
6,132,339 A * 10/2000 Wang et al. ..... 482/53
6,165,107 A * 12/2000 Birrell ..... 482/70
6,183,397 B1 * 2/2001 Stearns et al. ..... 482/52
6,210,305 B1 * 4/2001 Eschenbach ..... 482/52
6,248,045 B1 * 6/2001 Stearns et al. ..... 482/52
6,270,445 B1 * 8/2001 Dean et al. ..... 482/4
6,338,698 B1 * 1/2002 Stearns et al. ..... 482/52
6,340,340 B1 * 1/2002 Stearns et al. ..... 482/52
6,440,042 B2 * 8/2002 Eschenbach ..... 482/52
6,641,506 B1 * 11/2003 Yang ..... 482/52
6,689,019 B2 * 2/2004 Ohrt et al. ..... 482/52
6,758,790 B1 * 7/2004 Ellis ..... 482/52
6,786,851 B1 * 9/2004 Maresh ..... 482/52
6,849,033 B1 * 2/2005 Stearns et al. ..... 482/52
6,949,054 B1 * 9/2005 Stearns et al. ..... 482/52
6,994,657 B1 * 2/2006 Eschenbach ..... 482/52
7,121,984 B1 * 10/2006 Hong ..... 482/52
7,137,927 B2 * 11/2006 Maresh et al. ..... 482/52
7,238,146 B1 * 7/2007 Chen ..... 482/52
D559,925 S * 1/2008 Horita et al. ..... D21/670
2002/0019298 A1 * 2/2002 Eschenbach ..... 482/51
2002/0142889 A1 * 10/2002 Wu ..... 482/52
2002/0142890 A1 * 10/2002 Ohrt et al. ..... 482/52
2004/0043871 A1 * 3/2004 Chang ..... 482/52
2004/0053748 A1 * 3/2004 Lo et al. ..... 482/52
2004/0058784 A1 * 3/2004 Roberts, Jr. ..... 482/52
2004/0132583 A1 * 7/2004 Ohrt et al. ..... 482/52
2004/0157706 A1 * 8/2004 Miller ..... 482/52
2004/0266587 A1 * 12/2004 Miller ..... 482/52
2005/0049117 A1 * 3/2005 Rodgers, Jr. ..... 482/52
2005/0124466 A1 6/2005 Rodgers, Jr. ..... 482/52
2005/0124467 A1 6/2005 Rodgers, Jr. ..... 482/52
2005/0181912 A1 * 8/2005 Eschenbach ..... 482/52
2006/0003868 A1 * 1/2006 Lull et al. ..... 482/52
2006/0009330 A1 * 1/2006 Lo ..... 482/52
2006/0100065 A1 * 5/2006 Maresh et al. ..... 482/52
2006/0100066 A1 * 5/2006 Maresh et al. ..... 482/52
2006/0142122 A1 * 6/2006 Kettler et al. ..... 482/52
2006/0142123 A1 * 6/2006 Kettler et al. ..... 482/52
2006/0172862 A1 * 8/2006 Badarneh et al. ..... 482/52
2006/0247103 A1 * 11/2006 Stearns et al. ..... 482/52
2006/0281604 A1 * 12/2006 Stewart et al. ..... 482/51
2007/0087906 A1 * 4/2007 Rodgers, Jr. ..... 482/52
2007/0117684 A1 * 5/2007 Liao et al. ..... 482/52
2007/0117685 A1 * 5/2007 Liao et al. ..... 482/52
2007/0117686 A1 * 5/2007 Liao et al. ..... 482/52
2007/0135268 A1 * 6/2007 Wang ..... 482/52
2007/0161463 A1 * 7/2007 Eschenbach ..... 482/52
2007/0161465 A1 * 7/2007 Eschenbach ..... 482/52
2007/0179023 A1 * 8/2007 Dyer ..... 482/52
2007/0219061 A1 * 9/2007 Rodgers, Jr. ..... 482/52
2007/0219062 A1 * 9/2007 Rodgers ..... 482/52
2007/0219063 A1 * 9/2007 Anderson et al. ..... 482/52
2007/0219064 A1 * 9/2007 Anderson et al. ..... 482/52
2007/0219065 A1 * 9/2007 Anderson et al. ..... 482/52
2007/0238580 A1 * 10/2007 Wang ..... 482/52
2007/0298936 A1 * 12/2007 Ohrt et al. ..... 482/52

* cited by examiner

END OF TRAVEL STOP FOR AN EXERCISE DEVICE

RELATED APPLICATIONS

This application is related to U.S. patent application Ser. No. 11/646,883 titled "Supplemental Resistance Assembly For Resisting Motion Of An Exercise Device" Filed concurrently herewith and assigned to the same assignee as the present application.

FIELD OF THE INVENTION

The present invention relates to exercise equipment.

BACKGROUND OF THE INVENTION

The benefits of regular aerobic exercise have been well established and accepted. However, due to time constraints, inclement weather, and other reasons, many people are prevented from aerobic activities such as walking, jogging, running, and swimming. As a result, a variety of exercise equipment has been developed for aerobic activity.

From their humble beginnings as free weights and bicycles mounted on wooden platforms, exercise equipment such as stationary bicycles, treadmills, elliptical fitness trainers, stair climbers, and the like have grown increasingly sophisticated. However, the very advantage of the exercise equipment referenced above—the ability to use such equipment conveniently, in a relatively confined space, and in inclement weather—results in exercise devices that can be relatively monotonous to use. It is well known that the more stimulating and enjoyable the experience of exercising is to a user, the longer and more frequently that user will exercise. Unfortunately, many users find spending long hours doing repetitive forms of stationary exercise hard work and boring, sometimes so much so that the exercise equipment is abandoned in favor of more entertaining activity.

One type of exercise machine addresses the repetition of movement of the user by enabling the user to exercise without requiring a predetermined motion thereby gaining the desirable result of increasing mobility and freedom of movement, while minimizing boredom. Examples of such user defined motion fitness equipment can include pendulum motion-type exercise apparatus. Such user defined motion fitness equipment allow the user to control the foot path rather than the machine guiding the foot such as current elliptical machines, stepping machines and stationary cycles. One benefit user defined motion fitness equipment is that the user is able to control the stride length and overall foot motion to fit their needs, such as to replicate running, walking, or stepping. Another benefit is that the user can change between such motions whenever desired using a single exercise device.

However, existing user defined motion fitness equipment, such as pendulum motion-type exercise apparatus, have drawbacks. Existing user defined motion fitness equipment typically necessarily include limits or stops to prevent excessive travel or stride of the exercise device. Such limits or stops are necessary to prevent users from inadvertently over-extending or injuring themselves during use, and in some instances to prevent premature wear or failure of the exercise device. Existing exercise devices with end of travel limits or stops typically include very abrupt stops that provide a substantially immediate stop or end to the travel of the exercise device. These stops can be quite sudden and, at a minimum, can be unpleasant to the user. In more severe instances, such abrupt stops can contribute to an injury of the user. Abrupt stops can also interrupt the feel or the rhythm of a user's exercise routine.

Thus, a continuing need exists for an exercise device having a natural feeling end of travel stop. It would be advantageous to have a stop that was not abupt, but rather, provide a gentle indication to the user of the approaching end of travel. What is needed is an exercise device that enables the user to exercise muscles in a smooth natural manner over a large range of motion, without applying undesirable abrupt stops or limits to the user's motion. It would be desirable for such an exercise device to be configured for convenient use in a relatively confined space even in inclement weather. Further, a continuing need also exists for an exercise device that provides a variety of user defined unique engaging motions and is fun to use. It would also be desirable for such an exercise device to control or stop the travel when the user's foot reaches limits of travel of user defined motion fitness equipment without detracting from the unique engaging motion of the exercise device.

SUMMARY OF THE INVENTION

The present invention provides an exercise apparatus for a user. The exercise apparatus includes a frame, a crank system coupled to the frame, a pivotal linkage pendulum system, a foot member and a foot member end of travel apparatus. The crank system includes one or more crank members. The pivotal linkage pendulum system comprises at least a first link member. The first link member is coupled to the crank system through at least a first pivot point. The first pivot point of the first link member is configured to move in a path during use. The foot member is coupled to the at least one first link member. The foot member end of travel apparatus provides a progressive, non-linear stiffness profile to the foot member indicating the end of travel to the user.

According to a principal aspect of a preferred form of the invention, an exercise apparatus for a user. The exercise apparatus includes a frame, a crank system coupled to the frame, a linkage assembly, a foot engaging member, and an end of travel apparatus. The crank system includes at least one crank member. The linkage assembly is coupled to the frame and the crank system. The linkage assembly includes at least a first link member and a foot link. The foot engaging member is coupled to the foot link. The end of travel apparatus is configured to provide a predetermined maximum range of angular deflection after the linkage assembly first contacts the end of the travel apparatus, and a maximum torque value in opposition to the angular deflection. The end of travel apparatus provides first and second ranges of torque opposing the travel of the linkage assembly over first and second portions of the predetermined range of angular deflection, respectively.

This invention will become more fully understood from the following detailed description, taken in conjunction with the accompanying drawings described herein below, and wherein like reference numerals refer to like parts.

DETAILED DESCRIPTION OF THE INVENTION

While an exemplary embodiment of the invention has been illustrated and described, it will be appreciated that various changes can be made therein without departing from the spirit and scope of the invention.

FIGS. 1-8 illustrates an example embodiment of an exercise or fitness device suitable for use with the present invention. While the example embodiment described herein is a pendulum motion-type exercise device, the principles of the present invention apply to other fitness devices, particularly those in which the user is relatively mobile.

Figure 1:
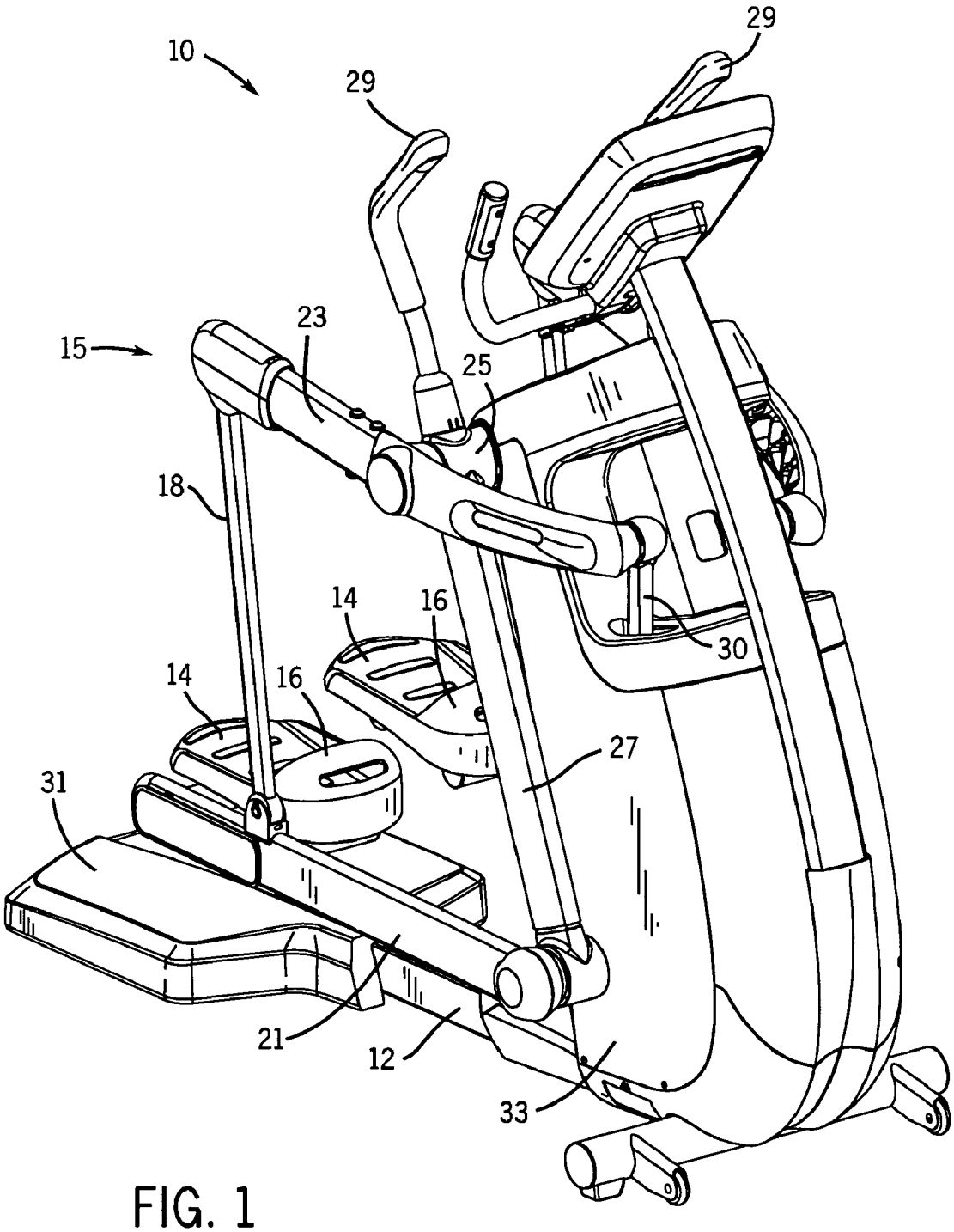
FIG. 1 is a front perspective view of an exercise device in accordance with the principles of the present invention.

Referring to FIG. 1, a perspective view of an embodiment of a pendulum motion-type exercise device 10 is seen. A frame 12 is provided that can include a basic supporting framework. The frame 12 can be any structure that provides support for one or more components of the exercise device 10. A pair of footpads 14 is provided on which the user stands. In one embodiment, a rear support base or platform 31 can be provided connected to the frame 12 that provides further support to the exercise device 10 and acts as a step-up to the footpads 14.

Left and right pivoting linkage pendulum systems 15 are provided. The discussion below will focus on the right pivoting linkage pendulum system 15. However, the description is applicable to the left pivoting linkage pendulum system 15 as well. In one embodiment, the linkage pendulum system 15 includes a lower and upper generally horizontal links 21 and 23, a rear link member 18, a forward generally vertical link 27, and a pivot tube 25 (the pivot tube can be solid or hollow and it serves as a pivot axis). The footpad 14 is coupled to a rear portion of the lower horizontal link 21. The lower horizontal link 21 serves as a footlink linking the footpad 14 to the remaining portions of the pendulum system 15. The lower horizontal link 21 swings or oscillates, but remains generally at or near horizontal, during use. The horizontal link 21 is coupled near its rear end to a lower end of the rear link member 18 and is pivotally coupled at its forward end to the lower end of the forward vertical link 27. The rear link member 18 upwardly extends from its pivotal coupling with the lower horizontal link 21 in a generally vertical direction. The coupling of the rear link member 18 and the lower horizontal link 21 can occur adjacent a forward portion of the footpad 14. The upper end of the rear link member 18 is pivotally coupled to a rear portion of the upper horizontal link 23. The upper horizontal link 23 extends generally horizontally and maintains a position that is generally parallel with the lower horizontal link 21 during use. A central region of the upper horizontal member 23 is pivotally coupled to the pivot tube 25, and a forward end of the upper horizontal member 23 is pivotally coupled to an upper end of a vertical resistance link 30. The pivot tube 25 is directly coupled to the frame 12. The pivotal coupling of the central region of the upper horizontal member 23 to the pivot tube 25 enables the rear portion of the upper horizontal member 23 (a cantilevered end region of the upper horizontal member 23) to be raised upward or downward during use thereby allowing for more pronounced available vertical motion to the exercise device 10 during use. The forward vertical link 27 extends upward, generally vertically, from its coupling at its lower end to the forward end of the lower horizontal link 21. The forward vertical link 27 is pivotally coupled to the upper horizontal link 23 and the frame 12 at the pivot tube 25. Thus, the rear link member 18, the lower and upper horizontal links 21 and 23, the forward vertical link 27, and the pivot tube 25 comprise the pivotal linkage pendulum system 15.

Although the lower and upper horizontal links 21 and 23, and the forward vertical link 27 incorporate the terms horizontal and vertical, these terms are intended to refer to the general orientation of these links. The lower and upper horizontal links 21 and 23, and the forward vertical link 27 will not always lie in a horizontal plane or a vertical plane, respectively. Rather, there positions will remain at or near the respective horizontal or vertical planes during use or while in a rest position.

Additionally, the resistance systems of the present Application are referred to in terms of vertical and horizontal resistance systems. The terms vertical and horizontal, in context of the resistance systems, are used in association with an embodiment of the invention, and the invention is not limited resistances systems that are directed to vertical and horizontal movements only. Rather, the present Application relates to first and second resistance systems, or primary and supplemental resistance systems. The orientation or application of the first and second resistance systems is not limited to vertical and horizontal application only. The present invention involves the application of a second or supplemental resistance system to improve the operation of an exercise device and is not limited to a specific orientation for the second or supplemental resistance application.

A swing arm 29 can be provided by extending the forward vertical link 27 above the pivot tube 25 a predetermined amount. The length and configuration of the swing arm 29 can be varied to match a desired motion and/or feel during use. An aesthetic shroud 33 can partially cover the exercise device 10.

In use, the pivotal linkage pendulum system 15 and the remaining components of the exercise device, enable the user to increase or decrease the stride length or stride of the exercise device as desired. As the user increases his or her stride length or tries to increase his or her cadence, the potential for the foot of the user to disengage, slide or slip from, the footpad 14 increases. Thus, in one embodiment the footpads 14 can be provided with toe clips 16. The toe clips 16 can be fixedly or removably connected to the foot pads 14. In another embodiment, the toe clip 16 and be integrally formed with the foot pad 14. The toe clips 16 enable a user to easily and removably secure his or her foot on the footpad 14 while inhibiting forward movement or forward slippage of the user's foot during use. Accordingly, the toe clips 16 not only properly secure the user's feet with the exercise device 10, but the toe clips 16 also enable the user to readily impart a forward force onto the footpad 14 with the toe clip 16. In some configurations, the toe clips 14 can also enable the user to readily impart an upward force onto the toe clip 16 and foot pad 14 assembly. The user therefore can drive his or her foot forward and even upward without experiencing foot slippage. Additionally, by enabling the user to utilize these additional movements, additional large muscle group involvement is engaged throughout the exercise resulting in higher aerobic training effect. A still further benefit of the use of the toe clips is that more muscles can be exercised throughout the full range of motion rather than just during flexion or just during extension.

Figure 2:
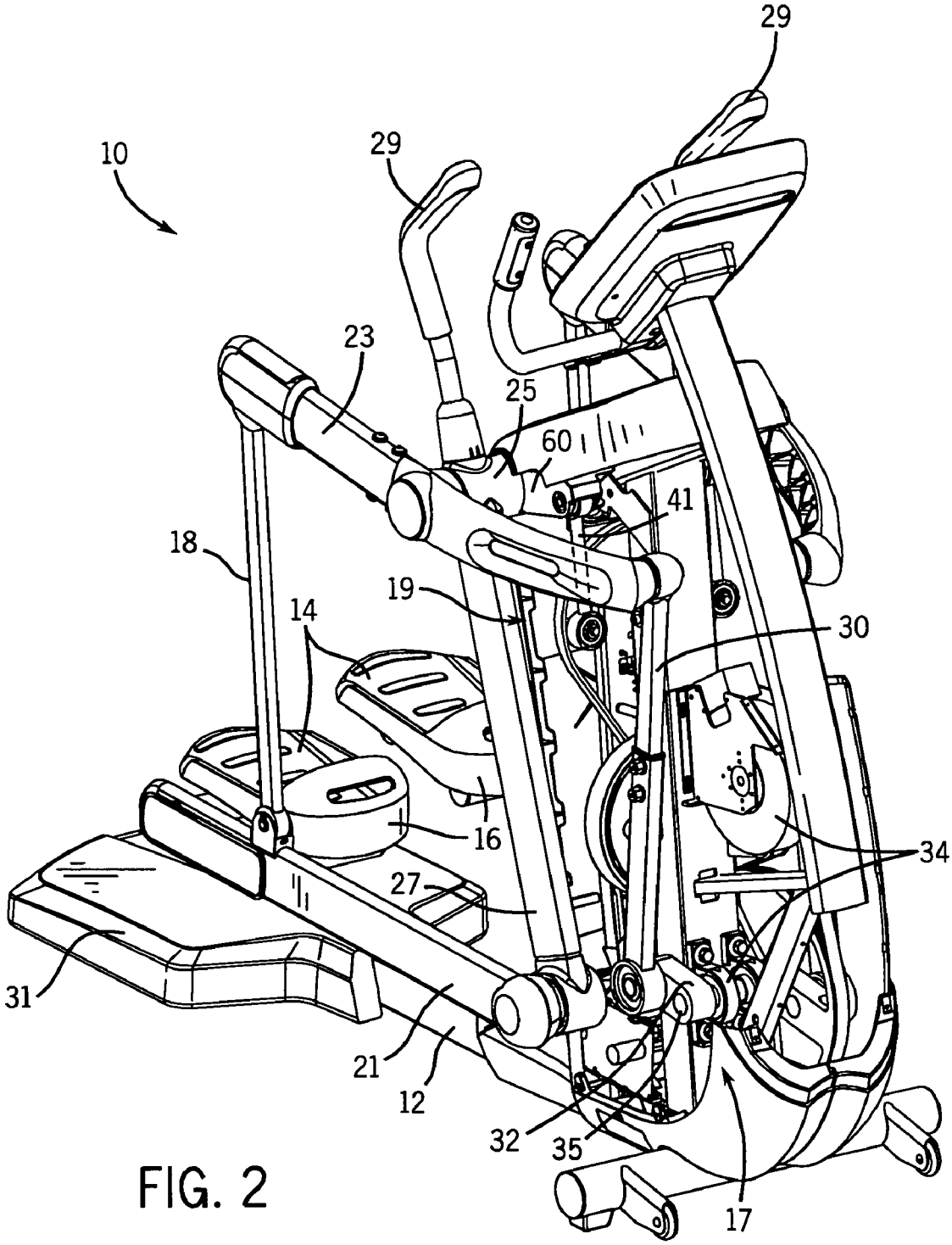
FIG. 2 is a front perspective view of the exercise device of FIG. 1 with a shroud removed.

FIG. 2 shows the pendulum motion-type exercise device 10 with the shroud 33 removed. The upper end of the vertical resistance link 30 is pivotally coupled to and extends generally vertically and downward from the forward end of the upper horizontal link 23. At an end opposite the upper horizontal link 23, the vertical resistance link 30 is connected to a generally vertical resistance system 17.

The vertical resistance system 17 can comprise a crank member 32 having a first end that is pivotally coupled to a lower end of the vertical resistance link 30. A second end of the crank member 32 is coupled to a shaft 35. During use, the back and forth motion of the lower horizontal link 21, the rear link member 18, and the forward vertical link 27 typically includes at least some vertical component that causes the upper horizontal link 23 to pivot about its pivotal coupling to the pivot tube 25. This pivotal movement causes the forward end of the upper horizontal link 23 to oscillate upward and downward. Further, when the user imparts a downward force onto the foot pad 14, or an upward force onto the toe clip 16, these forces also cause the upper horizontal member 23 to pivot or oscillate about its pivotal coupling to the pivot tube 25. This pivotal motion also contributes to the upward and downward oscillating motion of the forward end of the upper horizontal member 23. The shaft 35 and the pivot tube 25 each connect the left and right pivoting linkage pendulum systems 15, and the shaft 35 connects the left and right crank members 32 causes the left and right upper horizontal links 23 to move in opposition to each other (i.e., the right movable member moves downwards as the left movable member moves upwards, and vice versa). The crank member 32 is connected to a pulley system 34, which includes an electronically controlled generator mounted to the frame 12. The pulley system 34 can be preferably operatively connected to a step-up pulley, a flywheel, and a generator system for applying a braking or retarding force, as known in the art. Alternatively, braking or retarding forces can be applied using other mechanisms, such as for example an eddy current system, an alternator, friction brakes, fluid resistance, etc. Thus, a vertical resistance is applied to the upper horizontal link 23 by means of the crank member 32 and the vertical resistance system 17.

Figure 3:
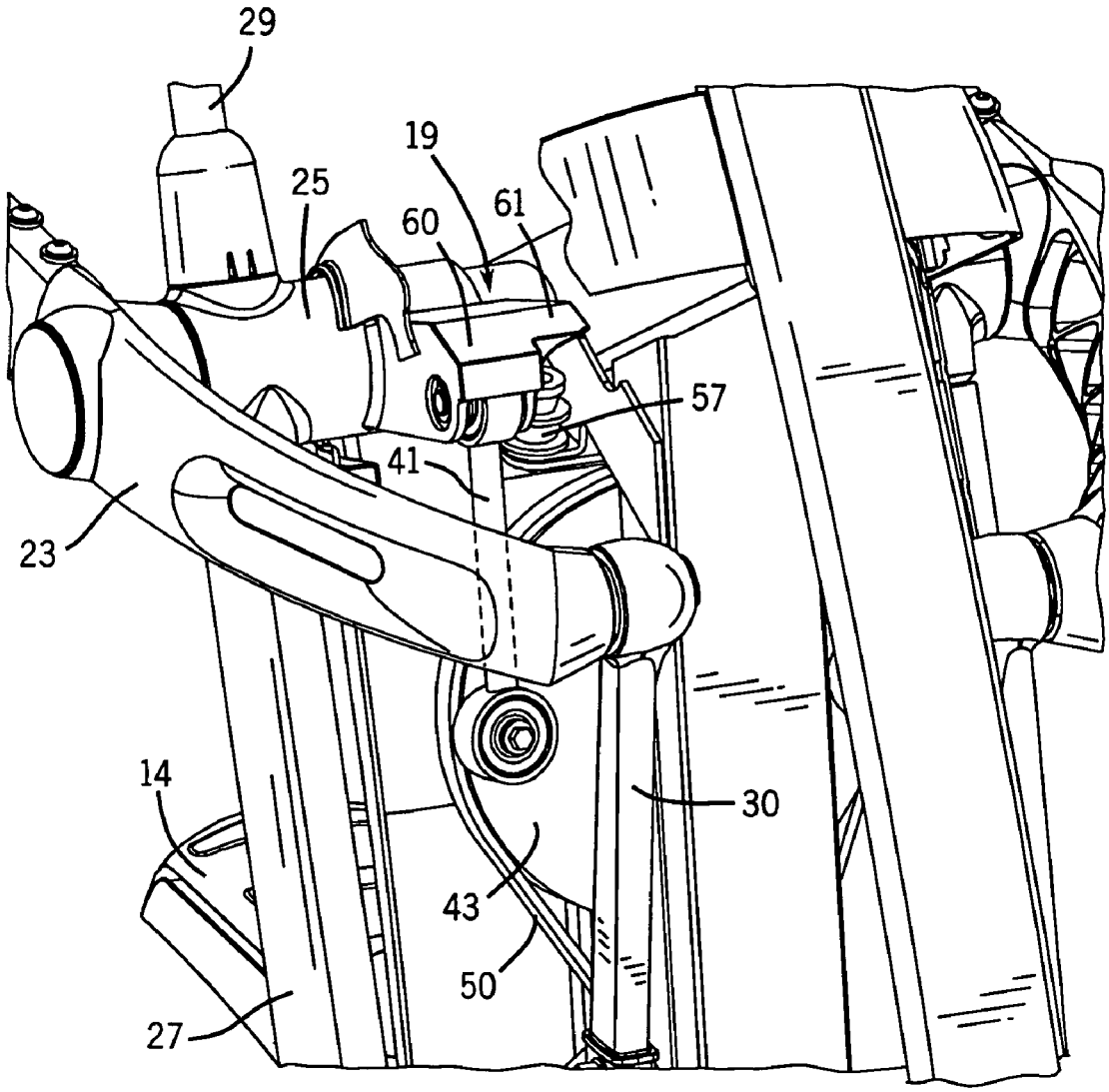
FIG. 3 is a detailed front perspective view of a portion of the exercise device of FIG. 1.

The back and forth (fore and aft) path of motion of the exercise device 10 also has a horizontal component, which has not been addressed in the prior art. Thus, an advantage of the exercise device of the present invention is that it provides for horizontal resistance (a second or supplemental resistance). In particular, the present invention provides a horizontal resistance system 19 (a second or supplemental resistance system). Referring to FIG. 3, a close-up of the pivot tube 25, the upper horizontal link 23, and the vertical resistance link 30 of the exercise device 10 is seen. A supplemental resistance link 41 is provided pivotally coupled to the pivot tube 25 by a rocker link 60 which outwardly extends from the pivot tube 25. The rocker link 60 pivots in coordination with the pivoting movement of the upper horizontal link 23 about the pivot tube 25. At an end of the supplemental resistance link 41 opposite the pivot tube 25, the supplemental resistance link 41 is connected to the horizontal resistance system 19.

The horizontal resistance system 19 can comprise a horizontal resistance pulley 43. The horizontal resistance pulley 43 comprises a rotating member pivotally coupled to the supplemental resistance link 41 opposite the pivot tube 25. The supplemental resistance link 41 is pivotally connected to the horizontal resistance pulley 43 near the outer periphery of the horizontal resistance pulley 43; thus the horizontal resistance pulley 43 acts as a crank member pivotally connecting the supplemental resistance link 41 and the horizontal resistance system 19.

Figure 4:
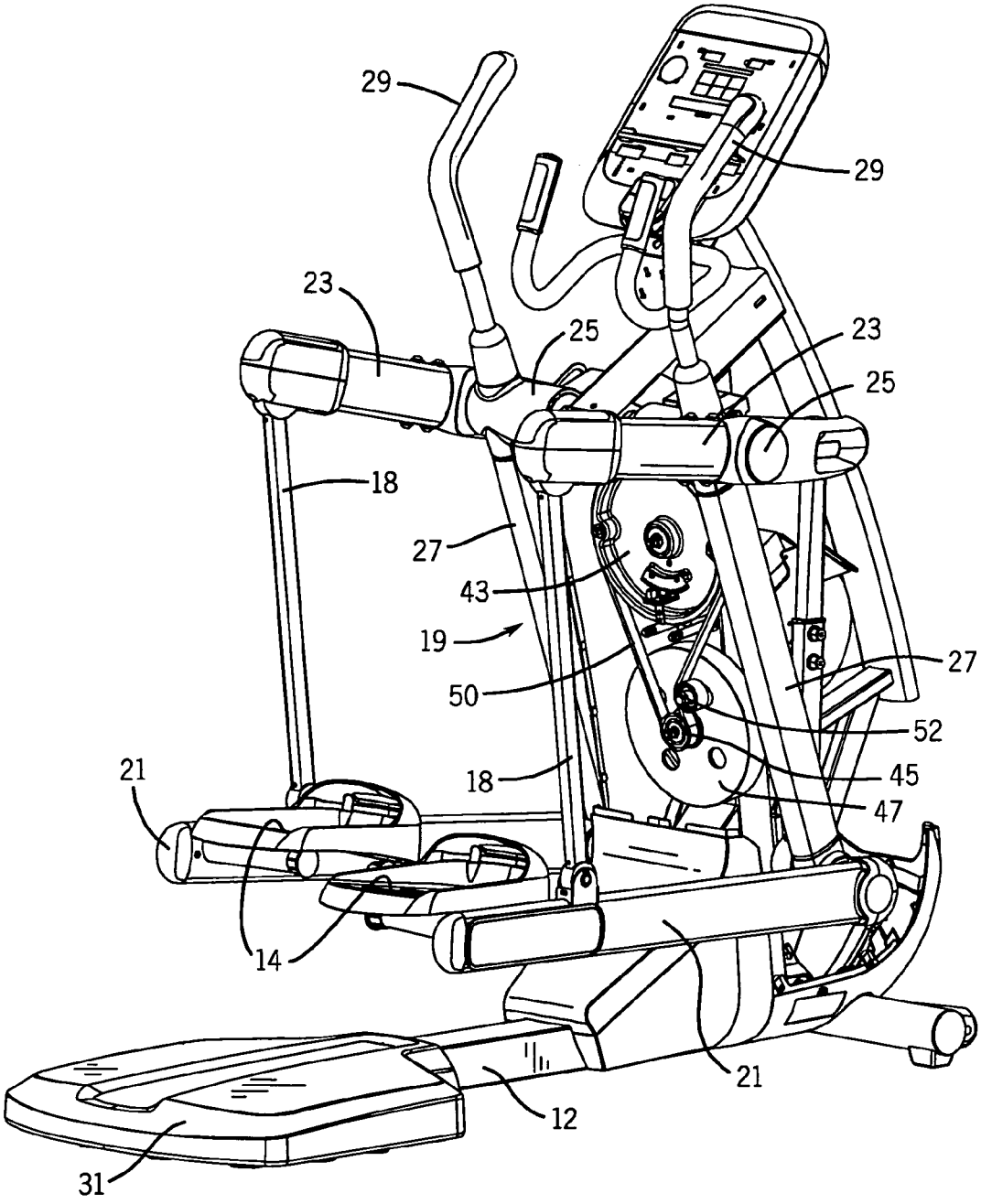
FIG. 4 is a rear perspective view of the exercise device of FIG. 2.
Figure 6:
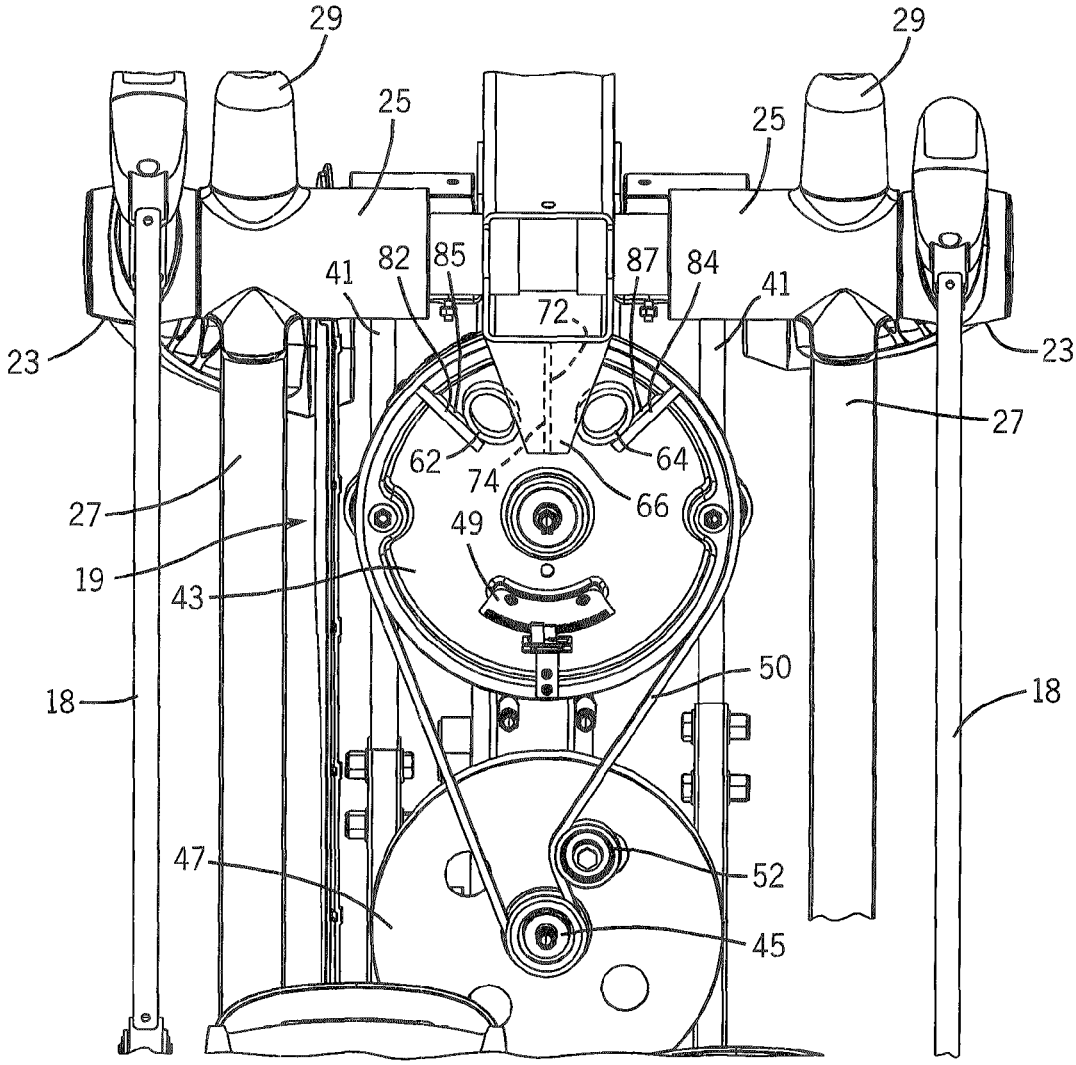
FIG. 6 is a detailed rear elevated view of a portion of the exercise device of FIG. 1.

Referring to FIGS. 4 and 6, the horizontal resistance pulley 43 also acts to provided resistance to the horizontal resistance system. The horizontal resistance pulley 43 is connected to a step-up pulley 45 and a flywheel 47 via a belt 50. Tension on the belt 50 can be maintained via an idler gear 52. In one embodiment, the flywheel 47 can be a rotating metallic flywheel and resistance can be provided by an eddy current brake 49 (seen in FIGS. 6 and 7). The horizontal resistance pulley 43 does not fully rotate in a complete 360 degree revolution; instead, the horizontal resistance pulley 43 rotates through an arch which is determined by the length of the stride of the user. Thus, if the user takes a short stride length, the total rotation of the arch of the horizontal resistance pulley 43 is relatively minimal; if the user takes a long stride length, the total rotation of the arch is relatively significant. By subjecting the rotating horizontal resistance pulley 43 to a means of resistance, the user is subjected to horizontal resistance in the fore and aft motions. In addition, the right and left footpads 14 are synchronized about 180 degrees out of phase by the horizontal resistance pulley 43, the supplemental resistance links 41 and the pivot shaft 25. This synchronization results allow for foot motion that simulates climbing, walking, jogging or running to be achieved. In an alternative embodiment, the right and left footpads 14 can be synchronized by a rocker link or other forms of couplings. In other embodiments, the right and left footpads and the right and left linkage pendulum systems can operate independent of each other or in a non-synchronous manner. In an alternative embodiment, a linear type resistance system can be used in place of the horizontal resistance pulley and related components. The link between the left and right footpads and the left and right linkage pendulum systems can also be accomplished with compliance between the left and right providing a loose or flexible coupling between left and right motions. Also, the movement of the left and right linkage pendulum systems can be configured in a phased operating arrangement.

The horizontal resistance system 19 of the present invention preferably provides adequate resistance to assist in stable foot motion, but not so much resistance as to make the fore and aft motion unnatural. Excessive resistance in the fore and/or aft directions can cause the foot path to distort in a vertical direction creating an unnatural foot path. In other instances, increased resistance in a fore and/or aft direction can make operation of the exercise device unsustainable for some users. In one embodiment, the level of resistance at the foot pad or the foot of the user in the fore and aft direction is within the range of about 0.5 pounds of force to about 15 pounds of force. The level of resistance can be variable within this range or constant value within this range. The variable resistance can be user adjustable, programmed, time-dependent, or vary based upon other parameters. In another alternative embodiment, the level of resistance at the foot pad or the foot of the user in the fore and aft direction is within the range of about 2.0 pounds of force to about 10.0 pounds of force. The variable resistance can be configured to vary based upon the velocity of the fore and aft motion of the foot pads or the linkage pendulum systems, or the variable resistance can vary based upon user selection, user programs or time or other parameters. The variation in resistance can be obtained by effectively starting and stopping the rotating metallic flywheel 47 of the eddy current brake 49 for fore to aft or aft to fore motions. The metal flywheel 47 is exposed to a magnetic field produced by permanent or electromagnets, generating eddy currents in the wheels. The magnetic interaction between the applied field and the eddy currents acts to slow the metal flywheel 47. The faster the metal flywheel 47 spins, the stronger the effect, meaning the effective horizontal resistance changes for zero force (at zero rotational velocity) to a maximum force at full rotational velocity. A variable resistance can be obtained through linear dampers (magnetic particle shock absorbers), pneumatic or hydraulic shock absorbers, or other non-constant resistance assemblies. Variability of resistance can also be provided by the start and stop of an inertial mass such as a larger flywheel without the need for additional resistance. A constant resistance can be obtained by utilizing a rotating constant torque brake (magnetic particle rotating brake) or other form of friction resistance.

In another embodiment, an electronic controlled horizontal resistance brake can be provided. Use of an electronic controlled horizontal resistance brake allows for pre-determined variations in the resistance throughout the stride, a constant resistance throughout the stride or an overall variability on the effective resistance to assist in interval training. The range of usable resistance at the foot in the fore and aft directions was found to be about 0.5 to about 15 pounds. In another embodiment, a linear resistance system can be provided.

Accordingly, the present invention provides a user with a variety of smooth natural available exercise paths or foot motions, exercises a relatively large number of muscles through a large range of motion, and provides such foot motions in a safe and stable manner. The present invention also provides an exercise device having available resistance in more than one general direction, such as resisted free travel in the fore and aft directions, without detracting from the unique engaging motion of the exercise device.

In addition to resistance on the vertical and horizontal movement, the movement of the pivotal linkage pendulum system 15 of the exercise device 10 also includes one or more stops for when the footpad 14 comes to the limit of the exercise device, also referred to as an end of travel stop, also referred to as an end of travel stop or an end of travel apparatus. In general, if an end of travel stop is too abrupt, an unsatisfactory jerking will occur to the user; indeed, if this stop is too abrupt and the user is utilizing a fast stride rate, the potential for injury to the user can increase. Accordingly, a need exists for an exercise device having a natural feeling end of travel stop. Applicants have determined that it is preferred that the end of travel have a two-stage linear stiffness profile or a non-linear stiffness profile.

Figure 5:
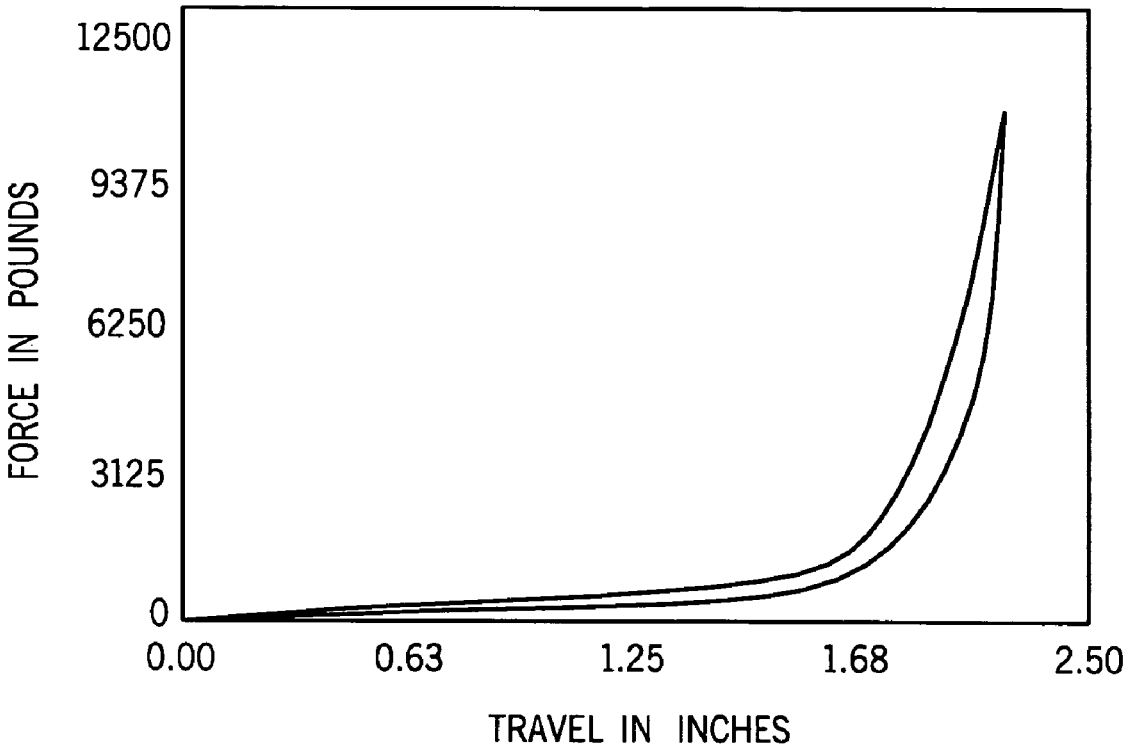
FIG. 5 is a graph of the non-linear profile of the stop point of the exercise device of FIG. 1.

This profile is graphed in FIG. 5. In FIG. 5, force in pounds is set forth on the vertical axis and travel in inches is set forth on the vertical axis. It is seen that as the travel increases the force in pounds is initially relatively flat, thereby providing the user with a gentle indication of the end of travel. Then, the force in pounds increases rapidly as the pre-determined stop point is approached. The softer initial contact can also provide a turn-around push for the user, as well as a smooth non-forceful signal that the end of travel is approaching.

One embodiment for achieving a two-stage linear or a progressive non-linear stiffness profile is a single bumper that provides a non-linear profile starting off relatively soft at initial contact, then producing an increase in stiffness at a pre-determined stop point. Referring back to FIG. 3, in one embodiment, the rocker link 60 includes stop tab 61 configured to engage a first bumper 57. The first bumper 57 serves as an end of travel stop that provides a highly stiff cushion and a rather abrupt stop when the stop tab 61 fully engages the first bumper 57. As part of the left and right pivoting linkage pendulum systems 15, the exercise device 10 also includes left and right rocker links 61, supplemental resistance links 41 and first bumpers 57.

Figure 7:
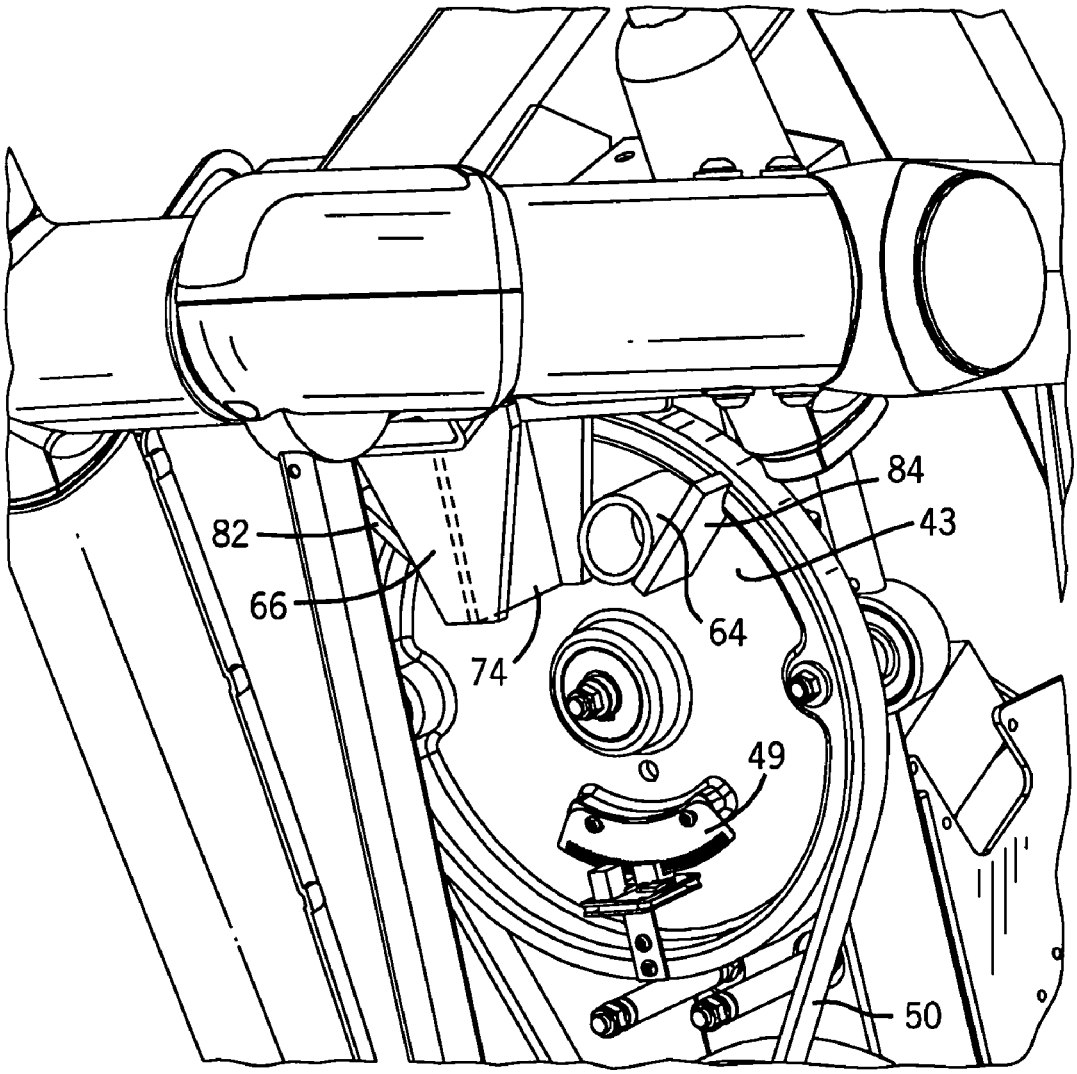
FIG. 7 is a detailed rear perspective view of another portion of the exercise device of FIG. 1.

Referring to FIGS. 6 and 7, in another embodiment, at least a pair of separate second bumpers 62, 64 can be utilized alone, or in combination with the first bumpers 57. In this embodiment, each of the second bumper 62 and 64 is configured to be relatively soft for the initial contact as the end of travel is approached and then becomes relatively stiff, or increasingly stiff, as the actual end of travel is approached. The first bumper 57, and the second bumpers 62 and 64 are preferably formed of an elastic material such as a polyester elastomer. Alternatively, the first and/or second bumpers can be formed of other materials such as, for example, butyl rubber, polyurethane, other elastomers, or combinations thereof. The elastic properties of the second bumpers 62 and 64 enable the bumpers to provide a gentle push to the user as the user reverses directions at the end of travel position. The gentle push improves the feel and comfort of the exercise device 10 and makes the exercise device more enjoyable to use. In combination, the second bumpers 62 and 64 and the first bumpers 57 provide an optimal two stage end of travel stop configuration for an exercise device in both the fore direction and the aft direction. The second bumpers 62 and 64 provide the initial soft end of travel indication that non-linearly increases if travel continues in the stop direction, and the first bumpers 57 provide the abrupt stop to ensure that the maximum travel of the exercise device is not exceeded, and the exercise device is not damaged, while minimizing the negative impact or feel to the user.

To provide for the at least two second bumpers 62 and 64, in one embodiment, a bumper bracket 66 can be provided extending over the horizontal resistance pulley 43. The bumper bracket 66 contains two contact surfaces 72, 74 adapted to contact and bear against the second bumpers 62 and 64. The second bumpers 62 and 64 are held in brackets 82, 84 having surfaces 85 and 87, respectively, contained on the horizontal resistance pulley 43. Thus, as the horizontal resistance pulley 43 comes to the limit of the exercise device 10 as rotating through the arch determined by the length of the stride of the user, one of the second bumpers 62 and 64 held on the horizontal resistance pulley 43 contacts the corresponding contact surface 72 and 74.

The end of travel stop or apparatus is configured to provide a predetermined range of travel after the linkage assembly first contacts the end of travel apparatus. The end of travel apparatus provides first and second ranges of resistance resisting the travel of the linkage assembly over first and second portions of the predetermined range of travel, respectively. One example, of the first and second ranges of resistance is shown on FIG. 5. The first and second ranges of resistance collectively provide a progressive, non-linear stiffness profile to the end of travel apparatus. In one embodiment, the first range of resistance is less than 1000 pounds of force over the first eighty (80) percent of the predetermined range of travel. In one embodiment, the predetermined range of travel of the end of travel stop can be within the range of greater than or equal to one inch to less than or equal to three inches. In another embodiment, the predetermined range of travel of the end of travel stop can be within the range of greater than or equal to 1.5 inches to less than or equal to 2.5 inches. In another embodiments, the first range of resistance is less than 1000 pounds of force over one of the first seventy (70) percent, the first sixty (60) percent or the first fifty (50) percent of the predetermined range of travel.

In another embodiment, the amount of force in pounds applied by the end of travel stop in the second range of resistance is at least 300 percent greater than the amount of force in pounds applied by the end of travel apparatus in the first range of resistance. In other embodiments, the second range of resistance can extends over the last forty percent, the last thirty percent or the last twenty percent of the predetermined range of travel. In other embodiments, the second range of resistance can be at least 400 percent greater, or at least 500 percent greater, than the amount of force in pounds applied by the end of travel apparatus in the first range of resistance.

The end of travel apparatus urges the linkage assembly in a direction opposite the direction at initial contact with the end of travel apparatus after the foot member reaches an initial end of travel position. The second bumpers 62 and 64 are each configured to provide a rebound or a push back in the opposite direction to the horizontal resistance pulley 43, which is ultimately felt by the user during use. This push improves the feel of the exercise device and further reduces any negative feedback resulting from engaging the end of travel stop or apparatus. The end of travel apparatus or assembly preferably provides a coefficient of restitution ("COR") of at least 0.60 percent. COR is a measure of energy loss or retention, and refers to the ratio of outgoing energy (also displayed in terms of speed or force) to incoming energy (also speed or force) of the linkage assembly engaging the end of travel apparatus or assembly. In another embodiment, the end of travel apparatus or assembly produces a COR of at least 0.70.

Figure 8:
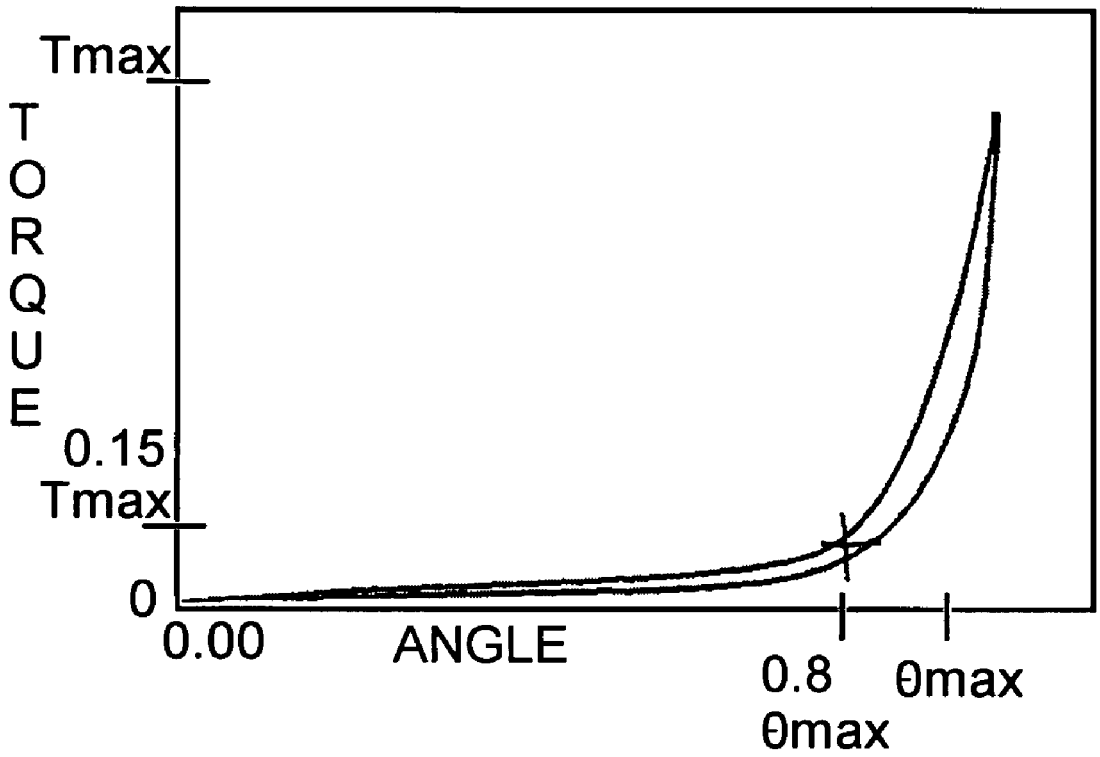
FIG. 8 is a torque versus angle graph of an end of travel stop assembly in accordance with the present invention.

FIG. 8 illustrates the non-linear end of travel stop assembly configuration of the present invention in an alternate manner. The progressive, non-linear response of the end of travel stop assembly in resistance to the movement of the linkage assembly can be represented in terms of torque versus angle, as shown in FIG. 8. The torque v. angle graph clearly demonstrates the two-stage performance of the end of travel stop assembly. The total amount of angular travel of the linkage assembly after making contact with the end of travel stop assembly can be defined in terms of an angular value of theta max ($\theta_{max}$) and the total amount of torque applied in resistance to the angular movement of the linkage can be defined in terms of a maximum torque value ($T_{max}$). In one embodiment, the first stage of the end of travel assembly can be defined by an amount of angular travel equivalent to approximately 0.8 $\theta_{max}$ (or 80 percent), which corresponds to an amount of torque that is approximately 0.15 $T_{max}$ (or 15 percent). In alternative embodiments, a torque value of approximately 0.15 $T_{max}$ can correspond to angular values as low as 0.6 $\theta_{max}$ (or 60 percent) to as high as 0.95 $\theta_{max}$ (or 95 percent) In other alternative embodiments, the torque value of approximately 0.15 $T_{max}$ can correspond to angular values as low as 0.7 $\theta_{max}$ (or 70 percent) to as high as 0.9 $\theta_{max}$ (or 90 percent). In still other embodiments, the angular displacement of 0.8 $\theta_{max}$ can correspond to a torque value within the range of greater than or equal to 0.05 $T_{max}$ to 0.25 $T_{max}$. In one embodiment, the maximum torque value $T_{max}$ can be 55,000 in-lbs and the maximum angular deflection of the end of travel stop assembly (such as a bumper assembly) can be approximately 20 degrees. In other embodiments, other values for maximum torque value $T_{max}$ and total angular deflection $\theta_{max}$ can also be used. These values can be configured to match the particular exercise device and a particular application of such an exercise device provided that the non-linear progressive torque versus angle performance characteristic is achieved.

Alternatively, the first bumper 57 can be provided with the non-linear response such that initial contact by the stop tab 61 is soft providing a gentle indication of the end of stop, then the first bumper 57 can be configured to have a non-linear increase in resistance if and when the stop tab 61 continues to engage the first bumper 57 and continues to bear against the first bumper 57. Both the single bumper and the dual bumper methods provide a unique feel that is crucial to a user defined motion exercise device. By correctly selecting the initial stiffness, the user does not sense the foot motion is approaching the end of travel, but instead senses a resistance that begins to urge the foot into the opposite direction. While the user defined motion exercise device allows for significantly longer stride lengths than most of the current exercise devices, the end of travel "push" tends to help the user to maintain a smooth and rhythmical motion required to achieve highly aerobic workout even while striding out to a maximum stride length.

While the invention has been described with specific embodiments, other alternatives, modifications and variations will be apparent to those skilled in the art. As previously described, while the example embodiment depicts a pendulum striding exercise device, the principles of the present invention apply to any other fitness devices, particularly those in which the user is relatively mobile, including but not limited to rowing machines, elliptical exercise machines, stepping machines, cross-country skiing machines, pendulous exercise devices, and the like. Accordingly, it will be intended to include all such alternatives, modifications and variations set forth within the spirit and scope of the appended claims.

What is claimed is:

1. An exercise apparatus for a user comprising:

a frame;

a crank system coupled to the frame, the crank system comprises one or more crank members;

a pivotal linkage pendulum system comprising at least a first link member, the first link member coupled to the crank system through at least a first pivot point, and the first pivot point of the first link member configured to move in a path during use;

a foot member coupled to the at least one first link member and supporting a footpad;

a member having an upper end pivotally coupled to the first link member and a lower end pivotally coupled to the foot member;

a foot member end of travel apparatus providing a progressive non-linear stiffness profile to the foot member indicating the end of travel to the user, the foot member end of travel apparatus comprising:

a first surface operably coupled to the pivotal linkage pendulum system such that movement of the pivotal linkage pendulum system and rotation of the one or more crank members transmits motion to the first surface so as to pivot the first surface in an arc;

a second surface stationarily supported by the frame; and a first bumper between the first surface and the second surface, wherein the bumper resiliently compresses during pivoting of the first surface in the arc towards the second surface.

2. The exercise apparatus of claim 1, wherein the foot member end of travel apparatus comprises at least a first bumper that provides a two-stage progressive non-linear stiffness profile.

3. The exercise apparatus of claim 1, wherein the foot member end of travel apparatus comprises a first bumper configured to provide a first stage of lesser resistance at a first foot member position that is further from the end of travel and a second stage of relatively stiffer resistance at second foot member position that is closer to the end of travel.

4. The exercise apparatus of claim 1, wherein the end of travel apparatus urges the foot member in the opposite direction after the foot member reaches an initial end of travel position.

5. The exercise apparatus of claim 1, wherein the end of travel apparatus provides for a predetermined range of travel after the pivotal linkage pendulum system first contacts the end of travel apparatus, and wherein the amount of force in pounds resisting the travel of the pivotal linkage pendulum system by the end of travel apparatus is less than 1000 pounds over the first eighty percent of the predetermined range of travel.

6. The exercise apparatus of claim 5, wherein the amount of force in pounds is less than 1000 pounds over the first seventy percent of the predetermined range of travel.

7. The exercise apparatus of claim 5, wherein the amount of force in pounds is less than 1000 pounds over the first sixty percent of the predetermined range of travel.

8. The exercise apparatus of claim 1, wherein the end of travel apparatus provides for a predetermined range of travel after the pivotal linkage pendulum system first contacts the end of travel apparatus, and wherein the amount of force in pounds applied by the end of travel stop to resist the travel of the pivotal linkage pendulum system increases by at least 300 percent in the last forty percent of the predetermined range of travel.

9. The exercise apparatus of claim 5, wherein the end of travel apparatus provides for a predetermined range of travel after the pivotal linkage pendulum system first contacts the end of travel apparatus, and wherein the amount of force in pounds applied by the end of travel stop to resist the travel of the pivotal linkage pendulum system increases by at least 300 percent in the last forty percent of the predetermined range of travel.

10. The exercise apparatus of claim 9, wherein the amount of force in pounds applied by the end of travel stop to resist the travel of the pivotal linkage pendulum system increases by at least 300 percent in the last thirty percent of the predetermined range of travel.

11. The exercise apparatus of claim 9, wherein the amount of force in pounds applied by the end of travel stop to resist the travel of the pivotal linkage pendulum system increases by at least 400 percent in the last forty percent of the predetermined range of travel.

12. The exercise apparatus of claim 5, wherein the predetermined range of travel of the end of travel stop is within the range of greater than or equal to one inch to less than or equal to three inches.

13. The exercise apparatus of claim 2, wherein the foot member end of travel apparatus comprises at least a set of first bumpers, wherein each of the first bumpers provides a progressive non-linear stiffness profile in a separate direction.

14. The exercise apparatus of claim 13, wherein the foot member end of travel apparatus further comprises a set of second bumpers, and wherein each second bumper is configured to engage the pivotal linkage pendulum system after the respective first bumper has engaged the pivotal linkage pendulum system.

15. The exercise apparatus of claim 2, wherein the two stage progressive non-linear stiffness profile to the foot member end of travel apparatus is provided by at least a first and second bumper, wherein the first bumper provides an initial lower level of force resisting the travel of the foot member, and wherein the second bumper provides a secondary higher level of force resisting the travel of the foot member.

16. The exercise apparatus of claim 1, wherein the footpad is provided with a forward securement member.

17. The exercise apparatus of claim 16, wherein the forward securement member is a toe clip.

18. The exercise apparatus of claim 1, wherein the pivotal linkage pendulum system comprises a corresponding pair of four or more bar linkages.

19. The exercise apparatus of claim 1, further comprising a step-up base, and wherein at least a portion of the base is positioned beneath at least a portion of the foot member.

20. The exercise apparatus of claim 1, wherein the pivotal linkage pendulum system includes a swing arm for engaging the upper body of the user.

21. The exercise apparatus of claim 1, wherein the foot member end of travel apparatus has a coefficient of restitution of at least 0.60.

22. The exercise apparatus of claim 1, wherein the foot member end of travel apparatus has a coefficient of restitution of at least 0.70.

23. The exercise apparatus of claim 1, wherein the end of travel apparatus provides for a predetermined maximum range of angular deflection after the pivotal linkage pendulum system first contacts the end of travel apparatus, wherein the end of travel apparatus also provides maximum torque value applied in opposition to the angular deflection.

24. The exercise apparatus of claim 23, wherein the amount of torque in inch-pounds applied by the end of travel stop to resist the angular deflection of the pivotal linkage pendulum system is within the range of 0.05 to 0.25 of the maximum torque value over approximately 80 percent of the maximum angular deflection of the end of travel apparatus.

25. The exercise apparatus of claim 24, wherein the amount of torque in inch-pounds applied by the end of travel stop to resist the angular deflection of the pivotal linkage pendulum system is within the approximately 0.15 of the maximum torque value over approximately 80 percent of the maximum angular deflection of the end of travel apparatus.

26. An exercise apparatus for a user comprising:

a frame;

a crank system coupled to the frame, the crank system comprises at least one crank members;

a first linkage assembly coupled to the frame and the crank system, the linkage assembly including at least a first link member and a foot link;

a first foot engaging member coupled to the first foot link;

a second linkage assembly coupled to the frame and the crank system, the linkage assembly including at least a first second link member and a foot link;

a second foot engaging member coupled to the second foot link;

a rotating member rotationally supported by the frame about an axis, wherein the first linkage assembly is coupled to the rotating member on a first side of the axis at a location spaced from the axis and wherein the second linkage assembly is coupled to the rotating member on a second side of the axis at a location spaced from the axis; and an end of travel apparatus configured to provide a predetermined maximum range of angular deflection of the rotating member about the axis after the linkage assembly first contacts the end of travel apparatus and a maximum torque value in opposition to the angular deflection, the end of travel apparatus providing first and second ranges of torque opposing the travel of the linkage assembly over first and second portions of the predetermined range of angular deflection of the rotating member, respectively, wherein the end of travel apparatus comprises at least a set of first bumpers, wherein each of the first bumpers provides a non-linear stiffness profile in a separate direction.

27. The exercise apparatus of claim 26, wherein the amount of torque in inch-pounds in the first range is within the range of 0.05 to 0.25 of the maximum torque value over approximately 80 percent of the maximum angular deflection of the end of travel apparatus.

28. The exercise apparatus of claim 27, wherein the amount of torque in inch-pounds applied by the end of travel stop to resist the angular deflection of the pivotal linkage pendulum system is within the approximately 0.15 of the maximum torque value over approximately 80 percent of the maximum angular deflection of the end of travel apparatus.

29. The exercise apparatus of claim 26, wherein the amount of angular deflection in the first range wherein the torque value is approximately 15 percent of the maximum torque value occurs at an angular deflection value that is greater than or equal to 70 percent of the maximum angular deflection and less than 90 percent of the maximum angular deflection.

30. The exercise apparatus of claim 29, wherein the amount of angular deflection in the first range wherein the torque value is approximately 15 percent of the maximum torque value occurs at an angular deflection value that is approximately 80 percent of the maximum angular deflection.

31. The exercise apparatus of claim 26, wherein the maximum angular deflection after the first linkage assembly first contacts the end of travel apparatus is approximately 20 degrees.

32. The exercise apparatus of claim 26, wherein the first and second ranges of torque collectively provide a progressive non-linear stiffness profile to the end of travel apparatus.

33. The exercise apparatus of claim 26, wherein the end of travel apparatus urges the first linkage assembly in a direction opposite the direction at initial contact with the end of travel apparatus after the first foot member reaches an initial end of travel position.

34. The exercise apparatus of claim 26, wherein the set of first bumpers are captured between the rotating member and the frame and wherein the end of travel apparatus further comprises a set of second bumpers, wherein the second bumpers are configured to engage the first linkage assembly and the second linkage assembly after the respective first bumper has engaged the pivotal linkage pendulum system.

35. The exercise apparatus of claim 26 wherein the first foot engaging member is provided with a forward securement member.

36. The exercise apparatus of claim 35, wherein the forward securement member is a toe clip.

37. The exercise apparatus of claim 26, wherein the pivotal linkage pendulum system includes a swing arm for engaging the upper body of the user.

38. An exercise apparatus for a user comprising:

a frame;

a crank system coupled to the frame, the crank system comprises one or more crank members;

a pivotal linkage pendulum system comprising at least a first link member, the first link member coupled to the crank system through at least a first pivot point, and the first pivot point of the first link member configured to move in a path during use;

a foot member coupled to the at least one first link member and supporting a footpad;

a foot member end of travel apparatus providing a progressive non-linear stiffness profile to the foot member indicating the end of travel to the user, wherein the foot member end of travel apparatus comprises:

at least a first bumper that provides a two-stage progressive non-linear stiffness profile:

at least a set of first bumpers, wherein each of the first bumpers provides a progressive non-linear stiffness profile in a separate direction; and a set of second bumpers, wherein each second bumper is configured to engage the pivotal linkage pendulum system after the respective first bumper has engaged the pivotal linkage pendulum system.

39. An exercise apparatus for a user comprising:

a frame;

a crank system coupled to the frame, the crank system comprises one or more crank members;

a pivotal linkage pendulum system comprising at least a first link member, the first link member coupled to the crank system through at least a first pivot point, and the first pivot point of the first link member configured to move in a path during use;

a foot member coupled to the at least one first link member and supporting a footpad;

a member having an upper end pivotally coupled to the first link and a lower end pivotally coupled to the foot member;

a foot member end of travel apparatus providing a progressive non-linear stiffness profile to the foot member indicating the end of travel to the user, wherein the foot member end of travel apparatus comprises a first and second bumper that provide a two-stage progressive non-linear stiffness profile and wherein the first bumper provides an initial lower level of force resisting the travel of the foot member, and wherein the second bumper provides a secondary higher level of force resisting the travel of the foot member.

40. The exercise apparatus of claim 1, wherein the member is configured to swing forward and rearward in a pendulum manner while the crank system remains stationary and not rotating.

* * * * *